United States Patent [19]

Faxon

[11] 4,240,265

[45] Dec. 23, 1980

[54] MIST SPRAY APPARATUS FOR AIR CONDITIONER CONDENSER

[76] Inventor: Robert L. Faxon, P.O. Box 17064, Pensacola, Fla. 32522

[21] Appl. No.: 10,462

[22] Filed: Feb. 8, 1979

Related U.S. Application Data

[63] Continuation-in-part of Ser. No. 832,923, Sep. 13, 1977, Pat. No. 4,170,117.

[51] Int. Cl.[3] ..... F28D 5/00

[52] U.S. Cl. ..... 62/171; 62/305; 239/282

[58] Field of Search ..... 239/282; 73/362.8; 62/184, 302, 305, 171, 214, 224; 236/DIG. 6, DIG. 12

[56] References Cited

U.S. PATENT DOCUMENTS

| | | | |
|---|---|---|---|
| 1,917,751 | 7/1933 | Chadwick et al. . | |
| 2,873,999 | 2/1959 | Webb | 239/282 X |
| 3,613,392 | 10/1971 | Di Tucci | 62/305 X |
| 3,967,172 | 6/1976 | Denny | 62/184 X |

*Primary Examiner*—William E. Wayner

*Attorney, Agent, or Firm*—Jacox & Meckstroth

[57] ABSTRACT

Apparatus for attachment to an air conditioner condenser for applying a mist of water or other liquid to the coils and fins of the condenser to improve the heat transfer capability of the condenser. The apparatus includes a spray nozzle, support structure for the spray nozzle, fluid conductors, a fluid valve member, a temperature sensing member, and a valve control member. The temperature sensing member, through the valve control member, causes the spray to operate only when certain predetermined temperature conditions exist. The temperature sensing member is positioned so that it, as well as the coils and fins of the condenser, receives water sprayed as a mist by the spray nozzle. Thus, the temperature conditions which exist in the coils and fins also exists in the temperature sensing member.

2 Claims, 6 Drawing Figures

MIST SPRAY APPARATUS FOR AIR CONDITIONER CONDENSER

RELATED APPLICATION

This application is a continuation-in-part of application Ser. No. 832,923, filed Sept. 13, 1977, now U.S. Pat. No. 4,170,117.

BACKGROUND OF THE INVENTION

Heat transfer between a fluid conductor or heat exchange member and the atmosphere can be improved by water or other liquid in contact with the surfact of the heat exchange member. Due to the fact that water absorbs heat only on the outer surface of droplets thereof, a multiplicity of droplets of very small size provides better heat transfer than larger droplets which are fewer in number.

It is therefore an object of this invention to provide apparatus which reduces and minimizes the cost of operation of an air conditioner system.

It is another object of this invention to provide means for automatic application of a minimum volume of water in the form of a fine mist to the heat exchange portion of an air conditioner condenser in accordance with the temperature of the heat exchange portion.

Another object of this invention is to provide such apparatus which can be easily and readily installed or attached to any "Freon" charged type of air conditioner condenser.

Another object of this invention is to provide support means for a spray nozzle so that the spray nozzle can be positioned at any desired location to spray a mist of liquid upon the heat transfer members ot a condenser of an air conditioner unit.

Another object of this invention is to provide means for automatic application of a fine mist of water to the heat exchange portion of an air conditioner condenser in such a manner that a minimum volume of water is used in providing maximum heat transfer.

Another object of this invention is to provide such apparatus which is relatively low in cost and which is long-lived.

Other objects and advantages of this invention reside in the construction of parts of the apparatus, the combination thereof, the method of manufacture, and the mode of operation, as will become more apparent from the following description.

SUMMARY OF THE INVENTION

The apparatus of this invention includes means for easy attachment of a spray nozzle to a condenser of an air conditioner and for properly positioning the spray nozzle with respect to the heat exchange portion of the condenser for spray of a fine water mist upon the heat exchange portion of the condenser. The apparatus also incudes a fluid conduit member for flow of water to the spray nozzle and a fluid valve for control of water flow in the fluid conduit member. The apparatus also includes a thermostat or temperature sensor positionable in engagement with the heat transfer portion of the condenser for sensing the temperature thereof. The temperature sensor is positioned in the heat transfer portion of the condenser so that the temperature sensing member receives a portion of the water which is sprayed by the spray nozzle. The thermostat or temperature sensor is joined to a control member which controls operation of the fluid valve.

DESCRIPTION OF THE PREFERRED EMBODIMENT

Figure 1:
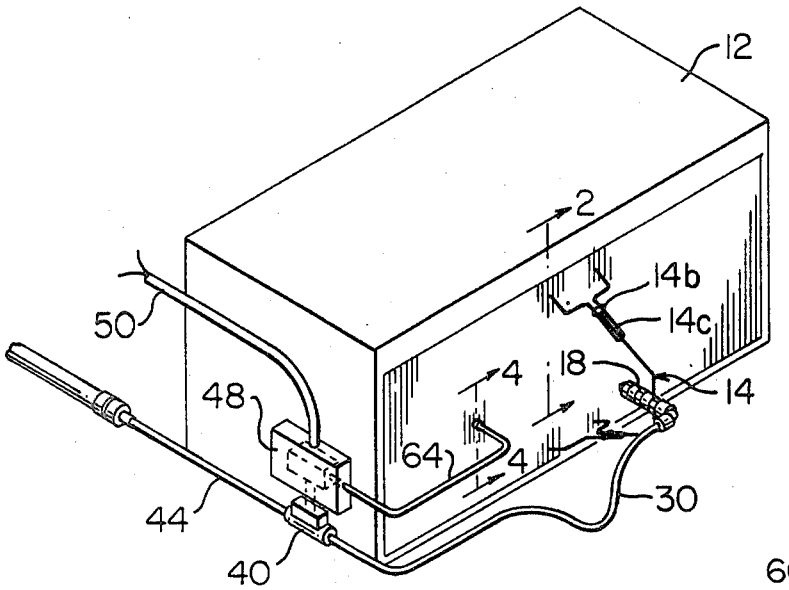
FIG. 1 is a perspective view of a condenser of an air conditioner, showing the apparatus of this invention in association therewith.
Figure 3:
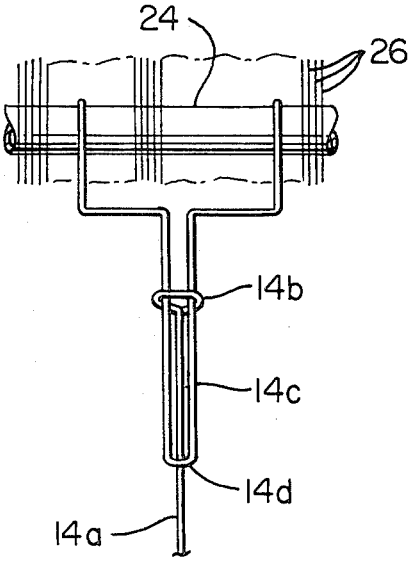
FIG. 3 is a fragmentary sectional view taken substantially on line 3—3 of FIG. 2.
Figure 5:
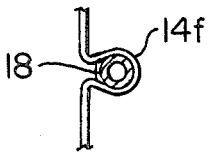
FIG. 5 is a fragmentary sectional view taken substantially on line 5—5 of FIG. 2.
Figure 2:
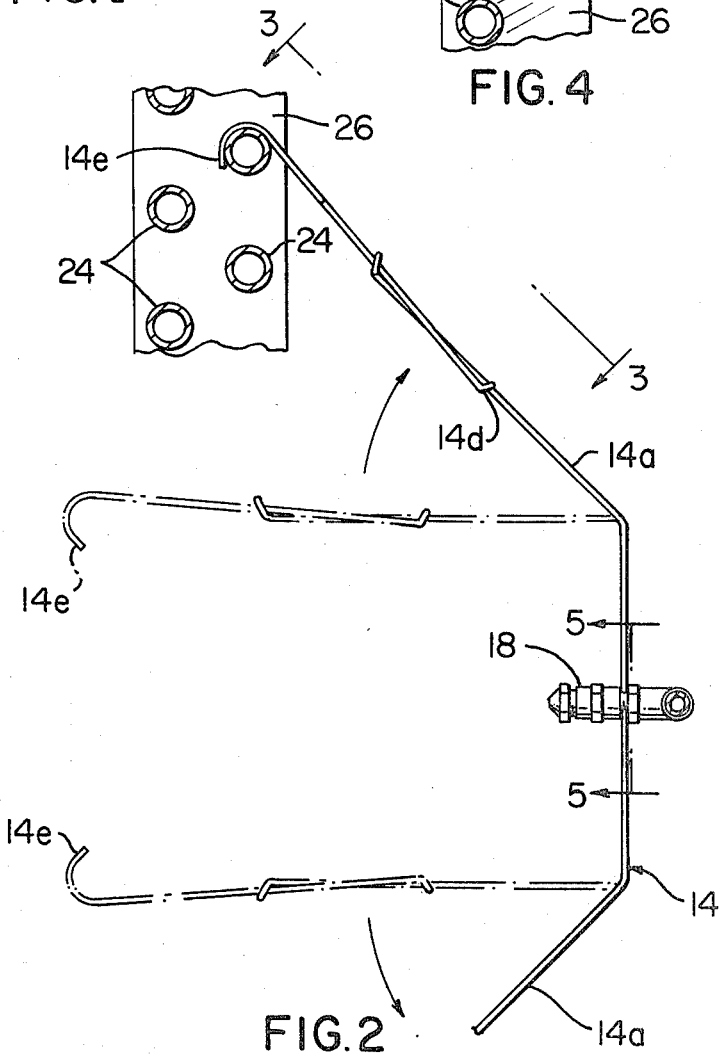
FIG. 2 is an enlarged fragmentary sectional view taken substantially on line 2—2 of FIG. 1.

A condenser or condenser member 12 of an air conditioner unit is shown in FIG. 1. A wire hanger assembly or support units 14 supports a spray nozzle member 18 and attaches the spray nozzle member 18 to the condenser member 12. The wire hanger assembly 14 comprises an elongate base **14*a*, provided with a loop 14*b* at each end thereof. A resilient U-shaped stem 14*c* extends through each of the loops 14*b*. Each U-shaped stem 14*c* has an arcuate end portion 14*d* which engages the elongate base 14*a*. The U-shaped stem 14*c* has a pair of spaced-apart hooks 14*e* at the ends thereof. The hooks 14*e* are adapted to hook over a fluid conductor, such as a fluid conductor 24 of the condenser 12, for support of the hanger assembly 14, as illustrated in FIGS. 2 and 3. The elongate base 14*a* may be bent as desired, as illustrated in FIG. 2 so that the spaced-apart hooks 14*e* may be positioned as desired upon fluid conductors 24. The fluid conductors 24 are shown as having fins 26 as an integral part thereof. The hooks 14*e* are forced into position between adjacent fins 26. The resiliency of the stem 14*c* within the loop 14*b* and the engagement of the arcuate end portion 14*d* with the base 14*a* retains the U-shaped stem 14*c* in desired position with respect to the base 14*a* when the hooks 14*e* are in engagement with fluid conductors 24**.

The elongate base **14*a* has an arcuate clamp portion 14*f* at the central portion thereof which partially encompasses the spray nozzle member 18 for support thereof and to retain the spray nozzle member 18 in position to direct a spray in a desired spray pattern upon the fluid conductors 24 and the fins 26**.

A fluid hose or pipe 30 is attached to the spray nozzle member 18 for flow of water thereto. The fluid hose or pipe 30 is joined to an electrically operable fluid valve 40. An inlet hose or pipe 44 is attached to the fluid valve 40 to provide water from a source thereof.

As shown in FIG. 1, the electrically operable fluid valve 40 is electrically connected to a control unit 48. Electric conductors 50 are adapted to be joined to a source of electrical energy and are also joined to the control unit 48.

Figure 4:
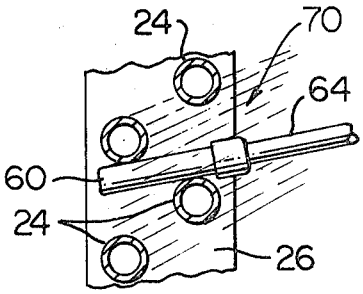
FIG. 4 is an enlarged fragmentary sectional view taken substantially on Line 4—4 of FIG. 1 and illustrating flow of the water spray to the temperature sensor.

A temperature sensor 60, best shown in FIG. 4, is positioned in engagement with at least one of the fluid conductors 24 in the condenser 12. The temperature sensor 60 is also tightly positioned among fins 26 and in engagement therewith, some of which are bent slightly to receive the temperature sensor 60. The temperature sensor 60 has a conductor 64 extending therefrom to the control unit 48. The temperature sensor 60 is positioned within the spray discharged from the spray nozzle member 18.

OPERATION

During operation of the air conditioner system of which the condenser 12 is a part, fluid, such as "Freon", carrying heat from the region cooled by the air conditioner system flows into the condenser 12 and through the fluid conductors 24 thereof at a lower pressure than in other parts of the system. Heat from within the fluid in the conductors 24 of the condenser 12 is transferred to the atmosphere as the fluid flows through the conductors 24. The amount of heat transferred to the atmosphere is related to the heat transfer characteristics and capability of the fluid conductors 24 and the fins 26.

Thermal conductivity of the conductors 24 and fins 26 is increased when water or other fluid is in engagement with the conductors 24 and fins 26. The heat transfer characteristics are also related to the size of the droplets of water on the surface of the conductors 24 and fins 26.

The spray nozzle 18 of the apparatus of this invention discharges a mist of very small droplets of water which engages the conductors 24 and fins 26 when a predetermined temperature exists in the fluid conductors 24, as discussed below. The mist discharged from the spray nozzle 18 also engages the temperature sensor 60 as illustrated generally by reference numeral 70 in FIG. 4. The temperature sensor 60 senses the temperature of the fluid conductors 24 and transmits information regarding the temperature thereof through the conductor 64 to the control unit 48. When the temperature of the conductors 24 reaches a predetermined magnitude, the control unit 48 operates the electrically operable fluid valve 40. The valve 40 is opened and water is permitted to flow through the pipe or hose 30 to the spray nozzle member 18. The spray nozzle member 18 discharges a very fine mist. Thus, a very fine mist is applied to the conductors 24, to the fins 26, and to the temperature sensor 60.

The droplets of water applied to the conductors 24, to the fins 26 and to the temperature sensor 60 is so fine that the mist evaporates almost immediately upon contact with the conductors 24, the fins 26, and the temperature sensor 60. The quantity of water discharged as a mist is limited so that when the temperature of the conductors 24 reaches the predetermined magnitude and the control unit 48 operates to cause a discharge of the mist, substantially all of the mist evaporates and there is no water run-off from the conductors 24, the fins 26, and the temperature sensor 60. As the droplets of mist evaporate from the fluid conductors 24 and from the fins 26, the heat transfer capability thereof is greatly enhanced, and the temperature of the fluid in the conductors 24 is reduced. In addition to being affected by the temperature of the fluid conductors 24, the temperature of the temperature sensor 60 is affected by the evaporation of the mist from the temperature sensor 60.

When this reduction in the temperature of the fluid in the fluid conductors 24 occurs, the temperature of the fluid conductors 24 is reduced, and the decrease in temperature is sensed by the temperature sensing member 60 and transmitted to the control unit 48. Due to the fact that the temperature sensor 60 is in engagement with at least one of the conductors 24 and with at least one of the fins 26, and due to the fact that the temperature sensor 60 also receives mist sprayed by the spray nozzle 18, the temperature sensor 60 maintains substantially the same temperature as the fluid conductors 24 and the fins 26. Therefore, the temperature sensor 60 is extremely sensitive to the conditions within the condenser 12. When the temperature sensed by the temperature sensing member 60 decreases to a predetermined magnitude, the control unit 48 operates to close the fluid valve 40, and water ceases to flow to the spray nozzle member 18. Thus, the mist spray to the conductors 24, to the fins 26 and to the temperature sensor 60 ceases.

It is therefore understood that the mist spray upon the conductors 24, the fins 26 and the temperature sensor 60, occurs only during the time that the temperature of the fluid in the conductors 24 is above a predetermined magnitude. Thus, the apparatus of this invention increases heat transfer from the fluid in the conductors 24 during the period of time that the fluid is above the predetermined temperature.

Figure 6:
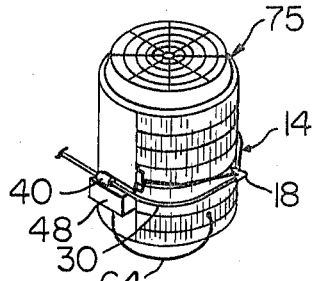
FIG. 6 is a perspective view, drawn on a smaller scale than the other figures, showing the apparatus of this invention associated with a condenser of a design different from the condenser illustrated in FIG. 1.

It is to be understood that the apparatus of this invention may comprise a plurality of support units 14 and spray nozzle members 18. The support units 14 may be attached to or supported by a condenser in a manner different from that illustrated in FIGS. 1–5. For example, a support unit 14 may be supported by the protective grill of a condenser 75, as illustrated in FIG. 6, or by any other portion of a condenser or by means adjacent thereto.

Although the preferred embodiment of the mist spray apparatus for an air conditioner condenser of this invention has been described, it will be understood that within the purview of this invention various changes may be made in the form, details, proportion and arrangement of parts, the combination thereof, and the mode of operation, which generally stated consist in a mist spray apparatus for an air conditioner condenser within the scope of the appended claims.

The invention having thus been described, the following is claimed:

1. Apparatus for minimizing the cost of operation of an air conditioner by applying a minimum volume of liquid mist onto a generally vertical heat exchange condenser which is a part of the air conditioning unit, the condenser including spaced fluid conduits connected to generally parallel spaced fins, said apparatus comprising a liquid spray nozzle for spraying a fine mist of liquid upon the fluid conduits of the condenser, a liquid supply line connected to said liquid spray nozzle, an electrically operated liquid control valve connected to control the flow of liquid through said supply line to said spray nozzle, a temperature sensing member positioned to receive a portion of the mist sprayed by the liquid spray nozzle and positioned to sense the temperature conditions within said condenser, the temperature sensing member being connected to control said liquid control valve, support means projecting outwardly in a cantilever manner from said condenser and supporting said liquid spray nozzle in horizontally spaced relation outwardly from said condenser with said liquid spray nozzle directed inwardly toward said fluid conduits and fins, said support means including a plurality of relatively adjustable elongate support members having portions for engaging a portion of said condenser, and said plurality of relatively adjustable support members being adaptable and adjustable for conveniently attaching said liquid spray nozzle to various spaced condenser conduits and various grill coverings of different air conditioning units.

2. Apparatus for minimizing the cost of operation of an air conditioner unit by applying a minimum volume of liquid mist onto a generally vertical heat exchange condenser which is a part of the air conditioning unit, the heat exchange condenser including spaced fluid conduits having generally parallel spaced fins attached thereto, said apparatus comprising a liquid spray nozzle, a liquid supply line connected to said spray nozzle, an electrically operated valve connected to control the flow of liquid through said supply line to said spray nozzle, a temperature sensing member positioned to sense the temperature of the fluid within the fluid conduits of said condenser and positioned to receive liquid sprayed by the spray nozzle, the temperature sensing member being connected to control said electrically operated valve, support means projecting outwardly in a cantilever manner from said condenser and supporting said spray nozzle in horizontally spaced relation outwardly from said condenser with said spray nozzle directed inwardly toward said fluid conduits and fins, said support means including a plurality of relatively adjustable elongate wire-like support members having end portions with hooks for engaging said fluid conduits of said condenser, the hooks also being adapted to hook upon a protective grill covering said condenser, and said plurality of relatively adjustable support members being adjustable for conveniently attaching said spray nozzle to various spaced condenser conduits and various grill coverings of different air conditioning units.

* * * * *